US008808525B2

(12) United States Patent
Schäfer

(10) Patent No.: US 8,808,525 B2
(45) Date of Patent: Aug. 19, 2014

(54) CYANIDE FREE ELECTROLYTE COMPOSITION FOR THE GALVANIC DEPOSITION OF A COPPER LAYER

(75) Inventor: Stefan Schäfer, Solingen (DE)

(73) Assignee: Enthone Inc., West Haven, CT (US)

( * ) Notice: Subject to any disclaimer, the term of this patent is extended or adjusted under 35 U.S.C. 154(b) by 100 days.

(21) Appl. No.: 13/054,048

(22) PCT Filed: Jul. 15, 2009

(86) PCT No.: PCT/US2009/050683
§ 371 (c)(1),
(2), (4) Date: Apr. 18, 2011

(87) PCT Pub. No.: WO2010/009225
PCT Pub. Date: Jan. 21, 2010

(65) Prior Publication Data

US 2011/0180415 A1 Jul. 28, 2011

(30) Foreign Application Priority Data

Jul. 15, 2008 (DE) ..... 10 2008 033 174

(51) Int. Cl.
*C25D 3/58* (2006.01)
*C25D 3/38* (2006.01)

(52) U.S. Cl.
CPC ... *C25D 3/38* (2013.01); *C25D 3/58* (2013.01)
USPC ..... 205/239; 205/291; 205/295; 205/296; 205/297; 205/298

(58) Field of Classification Search
USPC ..... 205/295, 296, 297, 298, 239, 291
See application file for complete search history.

(56) References Cited

U.S. PATENT DOCUMENTS

| | | | | |
|---|---|---|---|---|
| 2,700,019 | A | 1/1955 | Jernstedt et al. | |
| 3,310,430 | A * | 3/1967 | Schneble, Jr. et al. | 428/457 |
| 3,475,292 | A | 10/1969 | Shoushanian et al. | |
| 5,750,018 | A | 5/1998 | Brasch | |
| 6,331,239 | B1 | 12/2001 | Shirota et al. | |
| 6,508,927 | B2 * | 1/2003 | Yanada et al. | 205/241 |
| 6,511,589 | B1 | 1/2003 | Shindo | |
| 7,527,681 | B2 | 5/2009 | Poole et al. | |
| 2003/0155247 | A1 * | 8/2003 | Miura et al. | 205/157 |
| 2004/0253450 | A1 * | 12/2004 | Seita et al. | 428/411.1 |
| 2007/0221506 | A1 * | 9/2007 | Murakami | 205/261 |

FOREIGN PATENT DOCUMENTS

| | | | | |
|---|---|---|---|---|
| EP | 1876261 A1 * | 1/2008 | | C23C 18/40 |
| WO | WO 0245142 A2 * | 6/2002 | | H01L 21/288 |

OTHER PUBLICATIONS

International Search Report, PCT/US2009/050683, Nov. 10, 2009, 7 pages.
Written Opinion, PCT/US2009/050683, Nov. 10, 2009, 7 pages.

* cited by examiner

*Primary Examiner* — Edna Wong
(74) *Attorney, Agent, or Firm* — Senniger Powers LLP

(57) ABSTRACT

A cyanide-free electrolyte composition for the galvanic deposition of a copper layer on substrate surfaces and a method for the deposition of such layers. The electrolyte composition comprises at least copper(II) ions, a hydantoin and/or hydantoin derivative, a di- and/or tricarboxylic acid or salts thereof, and a metalate of an element of the group consisting of molybdenum, tungsten and vanadium and/or a cerium compound.

19 Claims, 1 Drawing Sheet

CYANIDE FREE ELECTROLYTE COMPOSITION FOR THE GALVANIC DEPOSITION OF A COPPER LAYER

REFERENCE TO RELATED APPLICATIONS

This application is the U.S. national stage application of International Patent Application No. PCT/US2009/050683, filed Jul. 15, 2009, and claims the benefit of German Application No. 10 2008 033 174.0, filed Jul. 15, 2008, the entire disclosures of which are incorporated herein by reference.

FIELD OF THE INVENTION

The present invention relates to a cyanide-free electrolyte composition for the galvanic deposition of a copper layer on substrate surfaces and a method for the deposition of such layers.

BACKGROUND OF THE INVENTION

The galvanic deposition of copper layers on different substrate surfaces has been known from prior art for a long time and has found its way into different areas of technology and is widely used. The deposition of copper layers is used both in the area of metalizing conductive substrates of various type, such as ferrous metals, steels or light metals, and in the area of metalizing non-conductive substrates, such as for example in the area of printed circuit board production or the production of wafers in semiconductor industry.

Typically, copper layers are deposited on different substrate surfaces from cyanide-containing electrolyte compositions by applying a suitable deposition current. The use of cyanide-containing copper electrolytes for the deposition of copper layers produces very good deposition results over a broad range of deposition current densities; however, it is environmentally unfriendly due to the cyanide content of the electrolytes. Besides high safety requirements for handling these electrolytes, costly wastewater treatment steps are necessary to avoid environmental pollution.

In prior art, attempts have been made to provide cyanide-free electrolyte compositions for the deposition of copper layers on substrate surfaces; however, all of them could not achieve the stability and range of application of cyanide-containing electrolyte compositions.

A further disadvantage of electrolyte compositions known from prior art is that they are either highly alkaline or strongly acidic, which means that in both cases special safety measures have to be observed when handling these electrolytes. In addition, the system components that come in contact with the respective electrolytes have to be made of highly corrosion-resistant materials.

SUMMARY OF THE INVENTION

Briefly, therefore, the invention is directed to an electrolyte composition and related method for the galvanic deposition of a copper layer on a substrate surface, the electrolyte composition comprising a source of copper(II) ions; a primary complexing agent comprising hydantoin, a hydantoin derivative, or a combination thereof; a secondary complexing agent comprising a dicarboxylic acid, a salt of a dicarboxylic acid, a tricarboxylic acid, a salt of a tricarboxylic acid, or any combination thereof; and a metalate comprising an element selected from the group consisting of molybdenum, tungsten, vanadium, cerium, and combinations thereof.

Other objects and features will be in part apparent and in part pointed out hereinafter.

BRIEF DESCRIPTION OF THE DRAWINGS

Corresponding reference characters indicate corresponding parts throughout the drawings.

DESCRIPTION OF THE EMBODIMENT(S) OF THE INVENTION

Figure 1:
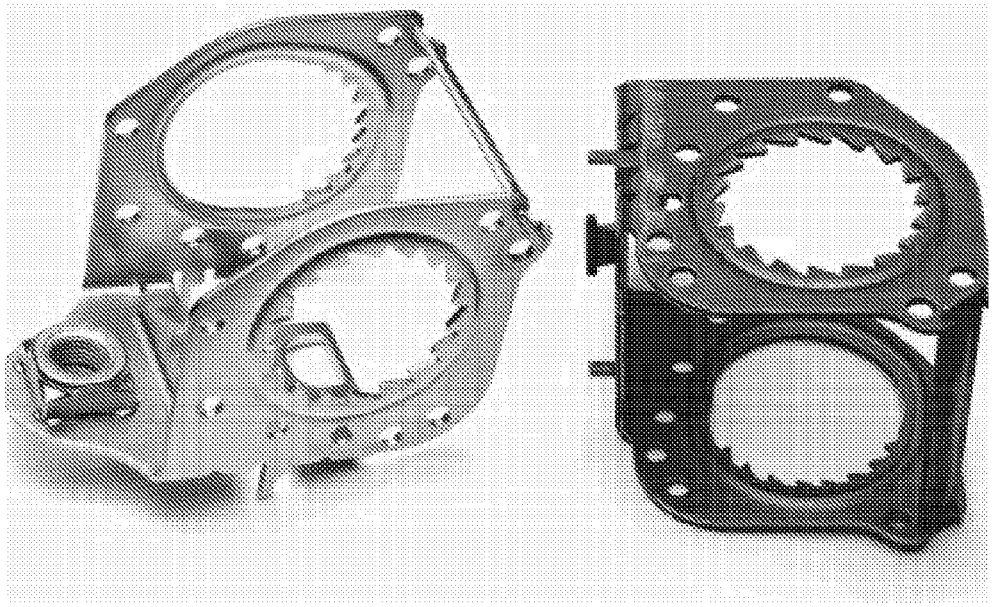
FIG. 1 shows a steel substrate prior to and after plating with a copper-containing layer using the electrolyte according to the invention and the method according to the invention.

This application claims priority to German application 102008033174.0, filed Jul. 15, 2008, the entire disclosure of which is incorporated by reference.

It is the object of the present invention to provide a cyanide-free electrolyte composition for the deposition of copper layers on substrate surfaces, which has high stability, gives satisfactory deposition results over a large deposition current density range, and in addition has a corrosiveness that is as low as possible. Moreover, it is the object of the present invention to provide a suitable method for the galvanic deposition of copper layers on substrate surfaces.

With regard to the electrolyte, this object is solved by an electrolyte for the galvanic deposition of a copper layer on a substrate surface comprising a source of copper(II) ions; a primary complexing agent selected from among hydantoin, a hydantoin derivative, or a combination thereof; a secondary complexing agent selected from among a dicarboxylic acid, a dicarboxylic acid salt, a tricarboxylic acid, a tricarboxylic acid salt, or any combination thereof; and a metalate comprising an element selected from the group consisting of molybdenum, tungsten and vanadium, and cerium. Preferably, the electrolyte of the present invention is alkaline.

The electrolyte according to the invention comprises copper(II) ions in a concentration between 5 g/L and the solubility limit, preferably between 5 g/L and 25 g/L. According to the invention, any copper compound that is adequately soluble in aqueous systems and which releases copper(II) ions may serve as source for copper(II) ions. Exemplary copper sources include copper(II) chloride, copper(II) bromide, copper sulfate, copper(II) hydroxide, copper methanesulfonate or copper acetate. In some embodiments, copper methanesulfonate has been shown to be particularly suitable. Due to the copper(I)/copper(II) equilibrium in aqueous solutions, copper(I) compounds can also be used as copper source according to the invention.

As primary complexing agent for complexing copper(II) ions in the electrolyte, the electrolyte according to the invention comprises hydantoin, a hydantoin derivative, or a combination thereof. Hydantoin and hydantoin derivatives as a complexing agent for copper in the electrolyte of the present invention is particularly advantageous since the formation constant of hydantoin for copper is high, and hydantoin and copper form stable complexes. Additionally, hydantoins are not hazardous, have sufficient water solubility, and are stable in alkaline solution.

Suitable hydantoin and hydantoin derivatives are those corresponding to the general formula:

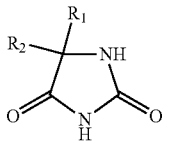

wherein $R_1$ and $R_2$ can independently be H, an alkyl group having 1 to 5 carbon atoms or a substituted or unsubstituted aryl group. Hydantoins and hydantoin derivatives include hydantoin, 5-methyl hydantoin, 5,5-dimethyl hydantoin, 5,5-diphenylhydantoin, and 5-methyl-5-phenylhydantoin. 5,5-dimethylhydantoin is particularly preferred. The particular hydantoin selection from among these and others requires verifying solubility in the overall electrolyte composition.

The electrolyte according to the invention comprises the primary complexing agent comprising hydantoin, a hydantoin derivative, or a combination thereof in a concentration between 0.15 mol/L and 2 mol/L, preferably 0.6 mol/L and 1.2 mol/L. Empirical results to date having indicated that increasing the acid or salt concentration or the concentration of secondary complexing agent, described below, in the electrolyte, the concentration of the hydantoin or its derivative can be decreased and is at the lower end of the required range.

According to the invention, the electrolyte further comprises a secondary complexing agent selected from among a dicarboxylic acid, a dicarboxylic acid salt, a tricarboxylic acid, a tricarboxylic acid salt, or any combination thereof. The secondary complexing agent also acts as a complexing agent for copper ions. Incorporation of a dicarboxylic acid, a tricarboxylic acid, salts thereof, and combinations thereof into the electrolyte of the present invention has been discovered to increase the long term stability of the electrolyte. In general, the dicarboxylic acid or tricarboxylic acid or salt thereof may have from 2 to about 12 carbon atoms, preferably from about 2 to about 6 carbon atoms. The hydrocarbyl group may be an alkyl group, an alkenyl group, or an alkynyl group. The hydrocarbyl group to which is bonded the multiple carboxylates may be substituted or unsubstituted. Substituted dicarboxylic acids and tricarboxylic acids may additionally comprise amino groups, lower alkyl groups having from 1 to about 5 carbon atoms, and halogen. Dicarboxylate and tricarboxylate salts may be also be used in the galvanic copper electrolyte of the present invention. Typical charge balancing cations include lithium, sodium, potassium, magnesium, ammonium, and lower alkyl quaternary amines, such as tetramethylammonium. Exemplary dicarboxylic acids include succinic acid, malic acid, aspartic acid, oxalic acid, malonic acid, methyl malonic acid, methyl succinic acid, fumaric acid, 2,3-dihydroxyfumaric acid, tartaric acid, glutaric acid, glutamic acid, adipic acid, pimelic acid, suberic acid, azelaic acid, and sebacic acid. Exemplary tricarboxylic acids include citric acid, isocitric acid, aconitic acid, and propane-1,2,3-tricarboxylic acid. Preferred dicarboxylic or tricarboxylic acids are citric acid, tartaric acid, succinic acid, malic acid, aspartic acid or salts thereof, individually or as mixture.

In a preferred embodiment, the electrolyte according to the invention comprises tartaric acid, a tartrate salt, citric acid, a citrate salt, and any combination thereof. Particularly preferably, the electrolyte comprises tripotassium citrate, triammonium citrate, trimagnesium citrate, trisodium salt, trilithium salt, sodium dihydrogen citrate and disodium hydrogen citrate, individually or as mixture. In other preferred embodiments, the secondary complexing agent may comprise potassium sodium tartrate. In case the dicarboxylic and tricarboxylic acids mentioned above are used in the electrolyte according to the invention not as salts but in acidic form, alkalizing agents such as for example alkali or alkaline earth hydroxides have to be added to the electrolyte to adjust the pH. Examples are NaOH, KOH, LiOH, $Ca(OH)_2$ and the like.

The electrolyte according to the invention can comprise the secondary complexing agent selected from among a dicarboxylic acid, a dicarboxylic acid salt, a tricarboxylic acid, a tricarboxylic acid salt, and combinations thereof in a concentration between 0.05 mol/L and 1 mol/L, preferably between 0.05 mol/L and 0.5 mol/L, more preferably between 0.05 mol/L and 0.25 mol/L.

In some embodiments, the electrolyte according to the invention may optionally comprise a further complexing agent from the group consisting of potassium pyrophosphate, sodium pyrophosphate, polyphosphates, pyridinesulfonic acid, tetrapotassium pyrophosphate, disodium dihydrogen pyrophosphate, tetrasodium pyrophosphate, methylglycinediacetic acid or salts thereof, and nitrilotriacetic acid or salts thereof. Incorporation of one of the above-described further complexing agents was discovered to improve the long term stability of the electrolyte and improve the throwing power.

The further complexing agents selected from among potassium pyrophosphate, sodium pyrophosphate, polyphosphates, pyridinesulfonic acid, tetrapotassium pyrophosphate, disodium dihydrogen pyrophosphate, tetrasodium pyrophosphate, methylglycinediacetic acid or salts thereof, and nitrilotriacetic acid or salts thereof optionally included in the electrolyte according to the invention can be included in the electrolyte according to the invention in a concentration of up to 1 mol/L, preferably between 0.1 mol/L and 1 mol/L.

In embodiments of the electrolyte wherein the further complexing agent selected from among potassium pyrophosphate, sodium pyrophosphate, polyphosphates, pyridinesulfonic acid, methylglycinediacetic acid or salts thereof, and nitrilotriacetic acid or salts thereof is not used, the concentration of the secondary complexing agents selected from dicarboxylic acid, tricarboxylic acid, and combinations thereof can be up to 0.5 mol/L.

Preferably, the electrolyte according to the invention for the galvanic deposition of a copper layer has an alkaline pH. The pH may be between pH 8 and pH 13, preferably pH 8 and pH 11. The pH can be adjusted by adding a mineral acid or an organic acid, such as for example methanesulfonic acid, dimethanesulfonic acid, or methanedisulfonic acid, and by adding alkali hydroxides.

In a particularly preferred embodiment of the electrolyte, said electrolyte comprises a buffer having a working range between pH 8 and pH 11. Suitable buffers are for example phosphate buffers and borate buffers.

As a further component, the electrolyte according to the invention comprises a metalate of an element of the group consisting of molybdenum, tungsten and vanadium and/or a cerium compound in a concentration between 5 mmol/L and 21 mmol/L. The metalate has been discovered to have a grain-refining effect.

Exemplary sources of molybdenum oxide metalates include molybdate salts such as $MoO_3$ predissolved with TMAH; $Na_2MoO_4$; $Na_2Mo_2O_7$; $Na_6Mo_7O_{24}.4H_2O$; $Na_2Mo_3O_{10}.2H_2O$; $Na_6Mo_8O_{27}.4H_2O$; $K_2MoO_4$; $K_2Mo_2O_7$; $K_6Mo_7O_{24}.4H_2O$; $K_2Mo_3O_{10}.2H_2O$; $K_6Mo_8O_{27}.4H_2O$; $(NH_4)_2MoO_4$; $(NH_4)_2Mo_2O_7$; $(NH_4)_6Mo_7O_{24}.4H_2O$; $(NH_4)_2Mo_3O_{10}.2H_2O$; $(NH_4)_6Mo_8O_{27}.4H_2O$; dimolybdates ($Me_2Mo_2O_7.H_2O$); trimolybdates ($Me_2Mo_3O_{10}.nH_2O$); tetramolybdates ($Me_2Mo_4O_{13}$); metamolybdates ($Me_2H_{10-m}[H_2(Mo_2O_7)_6].nH_2O$; wherein m is less than 10); hexamolybdates ($Me_2Mo_6O_{19}.nH_2O$); octamolybdates ($Me_2Mo_8O_{25}.nH_2O$); paramolybdates ($Me_2Mo_7O_{22}.nH_2O$ and $Me_{12}Mo_{12}O_{41}.nH_2O$); wherein in the above Me is a counterion selected from among ammonium, tetramethylammonium, and alkali metal cations such as sodium and potassium and wherein n is an integer having a value corresponding to a stable or metastable form of the hydrated oxide; molybdic acids; molybdic acid salts of ammonium, tetramethylammonium, and alkali metals such as sodium and potassium; heteropoly acids of molybdenum; and other mixtures thereof.

Exemplary sources of vanadium oxide metalates include vanadate salts such as sodium salts, potassium salts, ammonium salts, and metavanadate salts such as ammonium or sodium salts, pyrovanadates ($V_2O_7^{4-}$), hexavanadates ($HV_6O_{17}^{3-}$), $V_2O_3$, $V_2O_4$, and $V_2O_5$.

Exemplary sources of tungsten oxide metalates are tungsten trioxide, tungstic acids, ammonium tungstic acid salts, tetramethylammonium tungstic acid salts, and alkali metal tungstic acid salts such as sodium tungstate and hydrates thereof, potassium tungstate and hydrates thereof, phosphotungstic acid, silicotungstate, other heteropolytungstic acids and other mixtures thereof.

The cerium source is a Ce(IV) salt or compound, such as cerium(IV) chloride, cerium(IV) acetate, cerium(IV) iodide, cerium(IV) bromide, cerium(IV) oxalate, cerium(IV) sulfate, cerium(IV) tungstate. A preferred source is cerium(IV) sulfate.

In a preferred embodiment, the electrolyte comprises an ammonium molybdate, sodium molybdate dihydrate, sodium tungstate dihydrate, sodium monovanadate or mixtures thereof.

In addition, the electrolyte according to the invention can comprise as a further component a conducting salt selected from the group consisting of potassium methanesulfonate, sodium methanesulfonate. The conducting salt can be included in the electrolyte according to the invention in a concentration between 0.5 mol/L and 1 mol/L.

Furthermore, the electrolyte according to the invention can comprise common ingredients such as wetting agents (TIB B40, Goldschmidt, capryliminodipropionate), brighteners, leveling agents or marking additives. As preferred wetting agent, the electrolyte can comprise a capryliminodipropionate (e.g. TIB B40 of Th. Goldschmidt).

In addition, the electrolyte according to the invention can comprise further deposition metals in suitable ionic form, which are deposited together with copper to form corresponding copper-containing alloy layers on the substrate surfaces. Suitable alloying metals besides tin and zinc are for example gold, silver or indium.

With regard to the method, the object on which the invention is based is solved by a method for the deposition of a copper-containing layer on a substrate surface, in which the substrate surface to be plated is brought into contact with an electrolyte comprising a source of copper(II) ions; a primary complexing agent selected from among hydantoin, a hydantoin derivative, or a combination thereof; a secondary complexing agent selected from among a dicarboxylic acid, a dicarboxylic acid salt, a tricarboxylic acid, a tricarboxylic acid salt, or any combination thereof; and a metalate comprising an element selected from the group consisting of molybdenum, tungsten, vanadium, and cerium with application of an electrical current between the substrate surface to be plated and a counter electrode, the substrate surface being cathodically contacted.

According to the invention, a current density between 0.05 $A/dm^2$ and 4 $A/dm^2$, preferably between 0.4 $A/dm^2$ and 4 $A/dm^2$, more preferably between 0.8 $A/dm^2$ and 4 $A/dm^2$, can be set.

Soluble copper anodes and/or inert electrodes such as for example platinized titanium anodes are suitable as counter electrode for use in the method according to the invention.

In accordance with the method according to the invention, the substrate surface to be plated is brought into contact with the electrolyte according to the invention at a temperature between 40° C. and 65° C.

The electrolyte according to the invention and the method according to the invention are suitable for both galvanic deposition of copper-containing layers in the so-called rack plating process, in which the substrates to be metal-plated are contacted individually, and for the deposition of corresponding copper-containing layers by means of barrel plating, in which the substrates to be metal-plated are present in a plating barrel as parts in bulk.

The deposition current required for the galvanic deposition of the copper-containing layer can be applied as direct current or as pulsed current or reverse pulse current in the method according to the invention. Application of a pulsed current leads to improvement in throwing power and luster.

The Examples below are examples for the electrolyte according to the invention and the method according to the invention; however, the invention is not limited to these exemplary embodiments.

Having described the invention in detail, it will be apparent that modifications and variations are possible without departing from the scope of the invention defined in the appended claims.

EXAMPLES

The following non-limiting examples are provided to further illustrate the present invention.

Example 1

A steel substrate (Fe 99.19%, 0.6% Mn, 0.15% C, 0.03% P, 0.035% S) was cathodically degreased for 45 sec. in an alkaline degreasing solution after alkaline hot degreasing for two minutes and an intermediate rinsing. After subsequent rinsing, an acid etching step occurred in a mineral acid etchant (Actane K, available from Enthone Inc.) comprising a mixture of hydrochloric acid, sulfuric acid and phosphoric acid, in which the substrate was contacted with the etchant solution for one minute. After a further rinsing step, anodic activation in an activation solution containing alkali hydroxide (Enprep OC, available from Enthone Inc.) occurred. After removal of the activation solution in a further rinsing step, the steel substrate was plated in an electrolyte according to the invention comprising:

10 g/L of copper as copper(II) ions,
50 g/L of tripotassium citrate,
100 g/L of potassium pyrophosphate,
100 g/L of 5,5-dimethylhydantoin and
2 g/L of ammonium molybdate Plating occurred at a solution temperature of 50° C. for one hour at a mean current density of 1 $A/dm^2$.

The plating result is shown in FIG. 1 in the left-hand picture. A semi-gloss, uniform copper layer with a layer thickness of about 8 μm was deposited.

Example 2

Plug shells and plug contacts of a brass alloy (64% Cu, 36% Zn) were pickled, after electrolytic degreasing for 45 seconds and subsequent rinsing for 20 sec., in 20% sulfuric acid. After subsequent rinsing, the substrates were contacted in a revolving screen with the electrolyte of Example 1 for 30 minutes with application of a current density of 1 A/dm$^2$.

Figure 2:
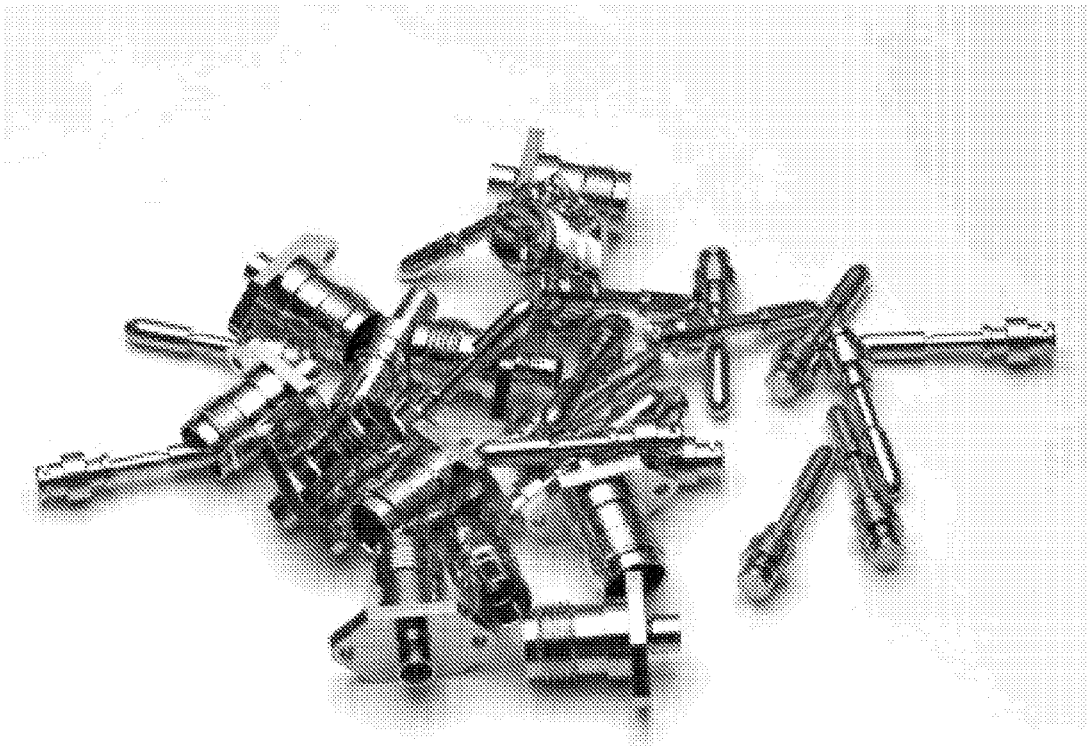
FIG. 2 shows barrel plating products of a brass alloy plated with a copper-containing layer using the electrolyte according to the invention and the method according to the invention.

The plating result is shown in FIG. 2. A glossy, uniform copper layer with a layer thickness of about 5 μm was deposited.

Example 3

A light metal substrate of a zinc-containing aluminum alloy (Zamak 5, ZnAl4Cu1) was first subjected to alkaline degreasing before it underwent alkaline etching. After the alkaline etching step and an intermediate rinsing step, the substrate surface was slightly etched in a hydrofluoric acid/nitric acid solution and subsequently pickled in a zincate pickling solution. After a further rinsing step, the etching/pickling step mentioned above was repeated before, after a further rinsing step, the light metal substrate surface was contacted with the copper electrolyte according to the invention for 60 min at 60° C. with application of a mean current density of 1.0 A/dm$^2$. The electrolyte has the following composition:

10 g/L of copper as copper(II) ions,
75 g/L of tripotassium citrate,
100 g/L of 5,5-dimethylhydantoin and
5 g/L of ammonium molybdate.

It was found that during contacting of the substrate with the electrolyte according to the invention without application of a deposition current, immersion deposition does not occur. This affects in particular the peel resistance of the deposited copper-containing layer. A semi-gloss, uniform copper layer with a layer thickness of about 6 μm was deposited.

Example 4

On a steel substrate as in Example 1, a zinc-nickel layer having a thickness of 2.5 μm was deposited after alkaline degreasing and an intermediate rinsing step. Onto this layer, a glossy, uniform copper layer of about 5 μm was deposited within 30 minutes from an electrolyte according to the invention as used in Example 1 after activation in 10% hydrochloric acid.

Example 5

A steel substrate (Fe 99.19%, 0.6% Mn, 0.15% C, 0.03% P, 0.035% S) was cathodically degreased for 45 sec. in an alkaline degreasing solution after alkaline hot degreasing for two minutes and an intermediate rinsing step. After subsequent rinsing, an acid etching step occurred in a mineral acid etchant (Actane K, available from Enthone Inc.), in which the substrate was contacted with the etching solution for one minute. After a further rinsing step, an alkaline, anodic activation (Enprep OC, available from Enthone Inc.) occurred. After removal of the activation solution in a further rinsing step, the steel substrate was plated in an electrolyte according to the invention comprising:

10 g/L of copper as copper(II) ions,
50 g/L of tripotassium citrate,
20 g/L of 5,5-dimethylhydantoin,
80 g/L of pyridinesulfonic acid, and
2 g/L of ammonium molybdate Plating occurred at a solution temperature of 60° C. for one hour at a mean current density of 1 A/dm$^2$.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above compositions and processes without departing from the scope of the invention, it is intended that all matter contained in the above description and shown in the accompanying drawings shall be interpreted as illustrative and not in a limiting sense.

What is claimed is:

1. An electrolyte composition for the galvanic deposition of a copper-containing layer on a substrate surface comprising:

a source of copper(II) ions;

a primary complexing agent comprising hydantoin, a hydantoin derivative, or a combination thereof;

a secondary complexing agent comprising a dicarboxylic acid, a salt of a dicarboxylic acid, a tricarboxylic acid, a salt of a tricarboxylic acid, or any combination thereof; and a metalate, wherein the metalate comprises an element selected from the group consisting of molybdenum, tungsten, vanadium, and combinations thereof and the concentration of the metalate is between 5 mmol/L and 21 mmol/L, and wherein the pH of the composition is between 8 and 13.

2. The electrolyte composition of claim 1 wherein the composition contains no cyanide.

3. The electrolyte composition according to claim 1 comprising a further complexing agent selected from the group consisting of potassium pyrophosphate, sodium pyrophosphate, polyphosphates, pyridinesulfonic acid, tetrapotassium pyrophosphate, disodium dihydrogen pyrophosphate, tetrasodium pyrophosphate, methylglycinediacetic acid, a salt of methylglycinediacetic acid, nitrilotriacetic acid, a salt of nitrilotriacetic acid, and combinations thereof.

4. The electrolyte composition according to claim 1, wherein the secondary complexing agent is selected from the group consisting of citric acid, succinic acid, malic acid, aspartic acid, tartaric acid, salts thereof and combinations thereof.

5. The electrolyte composition according to claim 1, wherein said source of copper(II) ions is present in a concentration such that the concentration of the copper(II) ions is between 5 g/L and the solubility limit.

6. The electrolyte composition according to claim 1, wherein said primary complexing agent comprising hydantoin, a hydantoin derivative, or a combination thereof is present in a concentration between 0.15 mol/L and 2 mol/L.

7. The electrolyte composition according to claim 1, further comprising a complexing agent selected from the group consisting of potassium pyrophosphate, sodium pyrophosphate, polyphosphates, pyridinesulfonic acid, tetrapotassium pyrophosphate, disodium dihydrogen pyrophosphate, tetrasodium pyrophosphate, methylglycinediacetic acid, a salt of methylglycinediacetic acid, nitrilotriacetic acid, a salt of nitrilotriacetic acid, and combinations thereof in a concentration between 0.1 mol/L and 1.0 mol/L.

8. The electrolyte composition according to claim 1, further comprising a conducting salt selected from the group consisting of potassium methanesulfonate, sodium methanesulfonate, and a combination thereof.

9. The electrolyte composition according to claim 8, wherein said conducting salt is present in a concentration between 0.5 mol/L and 1.0 mol/L.

10. The electrolyte composition according to claim 1, wherein said secondary complexing agent comprising a dicarboxylic acid, a salt of a dicarboxylic acid, a tricarboxylic acid, a salt of a tricarboxylic acid, or any combination thereof is present in a concentration between 0.05 mol/L and 1 mol/L.

11. The electrolyte composition according to claim 1 wherein:

the secondary complexing agent is selected from the group consisting of citric acid, succinic acid, malic acid, aspartic acid, tartaric acid, salts, and combinations thereof; and the concentration of the copper(II) ions is between 5 g/L and the solubility limit.

12. The electrolyte composition according to claim 11, further comprising a complexing agent selected from the group consisting of potassium pyrophosphate, sodium pyrophosphate, polyphosphates, pyridinesulfonic acid, tetrapotassium pyrophosphate, disodium dihydrogen pyrophosphate, tetrasodium pyrophosphate, methylglycinediacetic acid, a salt of methylglycinediacetic acid, nitrilotriacetic acid, a salt of nitrilotriacetic acid, and combinations thereof in a concentration between 0.1 mol/L and 1.0 mol/L; and further comprising a conducting salt selected from the group consisting of potassium methanesulfonate, sodium methanesulfonate, and a combination thereof.

13. The electrolyte composition according to claim 1 wherein the metalate is selected from the group consisting of a molybdenum oxide metalate, a vanadium oxide metalate, a tungsten oxide metalate, and combinations thereof.

14. The electrolyte composition according to claim 1 wherein the metalate is selected from the group consisting of ammonium molybdate, sodium molybdate dihydrate, sodium tungstate dihydrate, sodium monovanadate, and mixtures thereof.

15. A method for depositing a copper-containing layer on a surface of a substrate, the method comprising:

exposing the surface of the substrate to an electrolyte composition comprising:

a source of copper(II) ions, a primary complexing agent comprising hydantoin, a hydantoin derivative, or a combination thereof, a secondary complexing agent comprising a dicarboxylic acid, a salt of a dicarboxylic acid, a tricarboxylic acid, a salt of a tricarboxylic acid, or any combination thereof, and a metalate, wherein the metalate comprises an element selected from the group consisting of molybdenum, tungsten, vanadium and combinations thereof; and conducting a current between the substrate and an anode to thereby deposit the copper-containing layer on the surface of the substrate.

16. The method according to claim 15, wherein the electrolyte composition has a pH between pH 8 and pH 13.

17. The method of claim 15 wherein the substrate surface is cathodically contacted and a current density is applied between the cathodically contacted substrate surface and the anode, wherein the anode is between 0.05 $A/dm^2$ and 4 $A/dm^2$.

18. The method according to claim 15 wherein the metalate is selected from the group consisting of a molybdenum oxide metalate, a vanadium oxide metalate, a tungsten oxide metalate, and combinations thereof.

19. The method according to claim 15 wherein the metalate is selected from the group consisting of ammonium molybdate, sodium molybdate dihydrate, sodium tungstate dihydrate, sodium monovanadate, and mixtures thereof.

* * * * *